US009531056B2

(12) United States Patent
Liu et al.

(10) Patent No.: US 9,531,056 B2
(45) Date of Patent: Dec. 27, 2016

(54) PATCH ANTENNA AND WIRELESS COMMUNICATION DEVICE USING THE SAME

(71) Applicant: Sercomm Corporation, Taipei (TW)

(72) Inventors: Hsien-Wen Liu, Taipei (TW); Feng-Yu Lin, Taipei (TW); Ching-Hung Chen, Taipei (TW)

(73) Assignee: SERCOMM CORPORATION, Taipei (TW)

( * ) Notice: Subject to any disclaimer, the term of this patent is extended or adjusted under 35 U.S.C. 154(b) by 115 days.

(21) Appl. No.: 14/556,446

(22) Filed: Dec. 1, 2014

(65) Prior Publication Data

US 2015/0244060 A1 Aug. 27, 2015

(30) Foreign Application Priority Data

Feb. 27, 2014 (CN) ..... 2014 2 0087504 U

(51) Int. Cl.
*H01Q 1/24* (2006.01)
*H01Q 9/04* (2006.01)

(52) U.S. Cl.
CPC ..... *H01Q 1/24* (2013.01); *H01Q 1/243* (2013.01); *H01Q 9/0407* (2013.01)

(58) Field of Classification Search
CPC ..... H01Q 1/24; H01Q 1/243; H01Q 9/04; H01Q 9/0407
See application file for complete search history.

(56) References Cited

U.S. PATENT DOCUMENTS 6,982,673 B2 * 1/2006 Yuanzhu ..... H01Q 5/364 343/700 MS
7,589,673 B2 * 9/2009 Kuramoto ..... H01Q 1/243 343/700 MS

* cited by examiner

*Primary Examiner* — Hoang V Nguyen
(74) *Attorney, Agent, or Firm* — McClure, Qualey & Rodack, LLP

(57) ABSTRACT

A patch antenna includes an irradiation plate, a grounding point and a feeding point. The irradiation plate has a long edge. The grounding point is located at the long edge. The feeding point is located at the long edge. The grounding point and the feeding point are symmetrical with respect to a center of the long edge.

21 Claims, 3 Drawing Sheets

PATCH ANTENNA AND WIRELESS COMMUNICATION DEVICE USING THE SAME

This application claims the benefit of People's Republic of China application Serial No. 201420087504.7, filed on Feb. 27, 2014, the subject matter of which is incorporated herein by reference.

BACKGROUND

Field of the Disclosure

The disclosure relates in general to a patch antenna, and more particularly to a patch antenna having a symmetrical structure and a wireless communication device using the same.

Description of the Related Art

A wireless communication device may be installed on a ceiling. The wireless signal irradiated by the wireless communication device is usually strongest along the vertical direction. This may limit the coverage of the wireless signal to ensure that a large area on a floor can enjoy signal coverage, multiple wireless communication devices may need to be used.

SUMMARY

According to one embodiment of the present disclosure, a patch antenna is provided. The patch antenna includes an irradiation plate, a grounding point and a feeding point. The irradiation plate has a long edge. The grounding point is located at the long edge. The feeding point is located at the long edge. The grounding point and the feeding point are symmetrical with respect to a center of the long edge.

According to one embodiment of the present disclosure, a patch antenna is provided. The patch antenna includes an irradiation plate, a grounding point, a feeding point, a grounding plate, a grounding pin, a feeding pin and a feed line. The irradiation plate has a long edge and a short edge. The grounding point is located at the long edge. The feeding point is located at the long edge. The feeding point and the grounding point are symmetrical with respect to a center of the long edge, and the feeding point and the grounding point are adjacent to two ends of the long edge respectively. The grounding plate is parallel to the irradiation plate, and an area of the grounding plate is larger than that of the irradiation plate. The grounding pin connects the grounding point and the grounding plate. The feeding pin extends from the feeding point toward the grounding plate. The feed line connects to the feeding pin.

According to one embodiment of the present disclosure, a patch antenna is provided. The patch antenna includes an irradiation plate, a grounding point, a feeding point, a grounding plate, a grounding pin, a feeding pin and a feed line. The irradiation plate has a long edge and a short edge. The grounding point is located at the long edge. The feeding point is located at the long edge. The feeding point and the grounding point are symmetrical with respect to a center of the long edge, and the feeding point and the grounding point are adjacent to the center of the long edge. The grounding plate is parallel to the irradiation plate, and an area of the grounding plate is larger than that of the irradiation plate. The grounding pin connects the grounding point and the grounding plate. The feeding pin extends from the feeding point toward the grounding plate. The feed line connects to the feeding pin.

The above and other aspects of the disclosure will become better understood with regard to the following detailed description of the preferred but non-limiting embodiment(s). The following description is made with reference to the accompanying drawings.

DETAILED DESCRIPTION

Figure 1A:
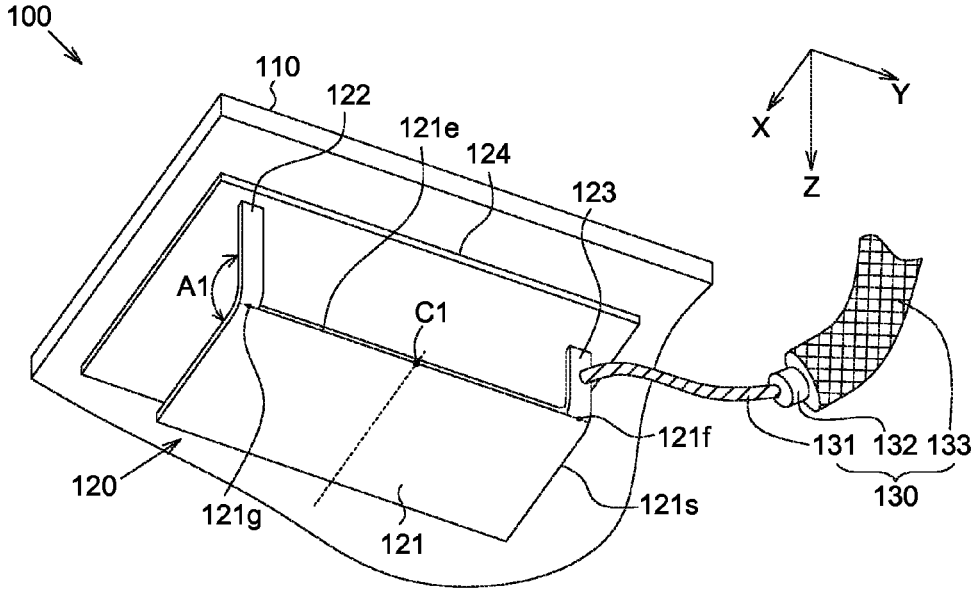
FIG. 1A illustrates a diagram of a wireless communication device according to an embodiment of the disclosure.

Referring to FIG. 1A, a diagram of a wireless communication device according to an embodiment of the disclosure is illustrated. The wireless communication device 100 may be a network communication device, such as a network router, a wireless access point, a femtocell or other wireless device capable of receiving and/or transmitting wireless signals. The wireless communication device 100 may be hanged up on the ceiling or a high position, such that the wireless signal may be irradiated downward (for example, toward +Z axis). The wireless communication device 100 includes a circuit board 110, a patch antenna 120 and a feed line 130. The patch antenna 120 may also be called "microstrip antenna".

The patch antenna 120 may be disposed on the circuit board 110. The patch antenna 120 includes an irradiation plate 121, a grounding point 121*g*, a feeding point 121*f*, a grounding pin 122, a feeding pin 123 and a ground plate 124. The wireless communication device 100 is deployed on the high position, with the irradiation plate 121 of the patch antenna 120 facing the ground.

In the present embodiment, the irradiation plate 121 is a rectangle. The irradiation plate 121 has a long edge 121*e* and a short edge 121*s*. The grounding point 121*g* and the feeding point 121*f* are located at the long edge 121*e*, and the grounding point 121*g* and the feeding point 121*f* are symmetrical with respect to a center C1 of the long edge 121*e*. In the present embodiment, a proportion of the short edge 121*s* to the long edge 121*e* may range between 1:1.87 and 1:3.6, such that the maximum gain of a radiation field for the patch antenna 120 is in a direction other than +Z axis.

Figure 1B:
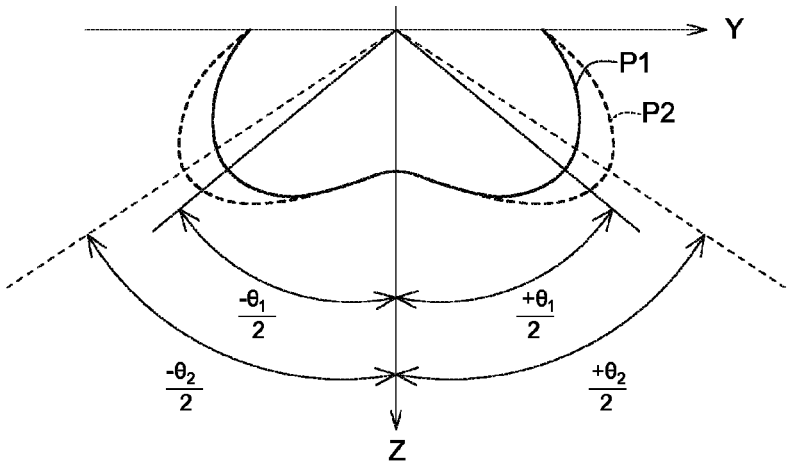
FIG. 1B illustrates the radiation field generated by the patch antenna of FIG. 1A.

Referring to FIG. 1B, the radiation field generated by the patch antenna of FIG. 1A is illustrated. Since the proportion of the short edge 121*s* to the long edge 121*e* may range between 1:1.87 and 1:3.6, the patch antenna 120 generates the radiation field P1. In such radiation field P1, the radiation intensity in two opposite sides of +Z axis is larger than the radiation intensity in +Z axis, and an radiation angle $\theta_1$ included between two directions of the maximum gains may be larger than 120 degrees. The larger the radiation angle $\theta_1$ is, the wider the coverage of the wireless signal is. Furthermore, to cover the same area on a floor, since the radiation angle $\theta_1$ of the patch antenna 120 is broadened, the number of the required wireless communication devices 100 may be reduced. In addition, the maximum gain of the irradiation field P1 may be larger than 2 dBi.

In addition, through the design of the proportion of the long edge 121*e* to the short edge 121*s*, various operation modes may be obtained. For example, in one embodiment, the proportion of the short edge 121*s* to the long edge 121*e* may range between 1:2.9 and 1:3.1, and thus the irradiation field generated by the patch antenna 120 may conform to TM02 operation mode. In another embodiment, the proportion of the short edge 121*s* to the long edge 121*e* may range between 1:2.34 and 1:2.35, and thus the irradiation field generated by the patch antenna 120 may conform to TM21 operation mode.

As illustrated in FIG. 1A, the grounding pin 122 connects the grounding point 121*g* and the ground plate 124, such that the grounding point 121*g* is electrically connected to the grounding plate 124 through the grounding pin 122. The feeding pin 123 outwardly extends from the feeding point 121*f* (for example, the feeding pin 123 extends toward the ground plate 124), but is not directly connected to the grounding plate 124. That is, an end of the feeding pin 123 is separated from the grounding plate 124 by a distance, so as to prevent the feeding point 121*f* from being electrically short with the grounding plate 124.

In an embodiment, the irradiation plate 121, the grounding pin 122 and the feeding pin 123 may be integrated into one-piece structure. In terms of manufacturing method, in an embodiment, a sheet metal process, such as bending and/or pressing, may be applied to a sheet metal to form the structure of the irradiation plate 121, the grounding pin 122 and the feeding pin 123. The angle A1 included between the grounding pin 122 and the feeding pin 123 with respect to the irradiation plate 121 may be equal to, less than or larger than 90 degrees. In another embodiment, at least two of the irradiation plate 121, the grounding pin 122 and the feeding pin 123 may be manufactured separately, and then combined together by way of welding, engaging, adhering, other temporary technique or other permanent technique.

As illustrated in FIG. 1A, the feed line 130 includes a feeding wire 131, an insulation layer 132 and a grounding mesh wire 133. An end of the feeding wire 131 is electrically connected to the circuit board 110, and another end of the feeding wire 131 connects to the feeding pin 123 by welding for transmitting the signal between the irradiation plate 121 and the circuit board 110. The insulation layer 132 encapsulates the feeding wire 131 and disposed between the feeding wire 131 and the grounding mesh wire 133, such that the feeding wire 131 is electrically isolated from the grounding mesh wire 133. The grounding mesh wire 133 may electrically connect the ground plate 124 and grounding potential, such that the ground plate 124 is grounded.

The ground plate 124 is configured parallel to the irradiation plate 121. In the present embodiment, the ground plate 124 is disposed opposite to the irradiation plate 121 in Z axis, such that an electromagnetic wave toward −Z axis irradiated by the irradiation plate 121 is reflected by the ground plate 124 to broaden toward two sides with respective to +Z axis, and thus generate the irradiation field P1 as illustrated in FIG. 1B.

Figure 1C:
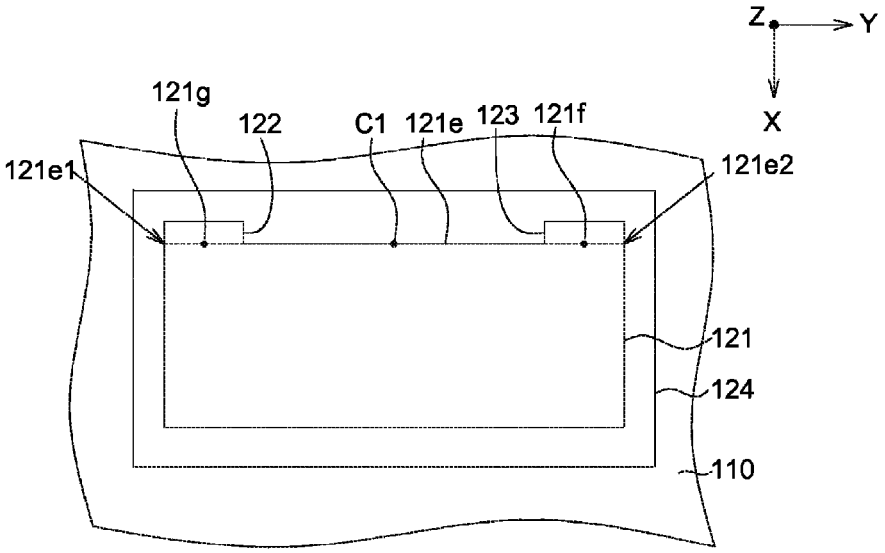
FIG. 1C illustrates a bottom view of the wireless communication device of FIG. 1A.

FIG. 1C illustrates a bottom view of the wireless communication device of FIG. 1A. In the present embodiment, an area of the ground plate 124 is larger than an area of the irradiation plate 121, and the projection of the entire irradiation plate 121 along the Z axis overlaps the ground plate 124. In another embodiment, the area of the ground plate 124 may be substantially equal to or less than the area of the irradiation plate 121. In addition, since the ground plate 124 overlaps the irradiation plate 121, such that the grounding pin 122 may extend toward the ground plate 124 and connects with ground plate 124.

In the present embodiment, the grounding point 121*g* and the feeding point 121*f* are adjacent to a first end 121*e*1 and a second end 121*e*2 of the long edge 121*e*, respectively. The term "adjacent" means "close to but not contact" or "directly contact". In one embodiment, a distance between the grounding point 121*g* and the center C1 is larger than half distance or two-third distance between the center C1 and the first end 121*e*1, and a distance between the feeding point 121*f* and the center C1 is larger than half distance or two-third distance between the center C1 and the second end 121*e*2.

Figure 2:
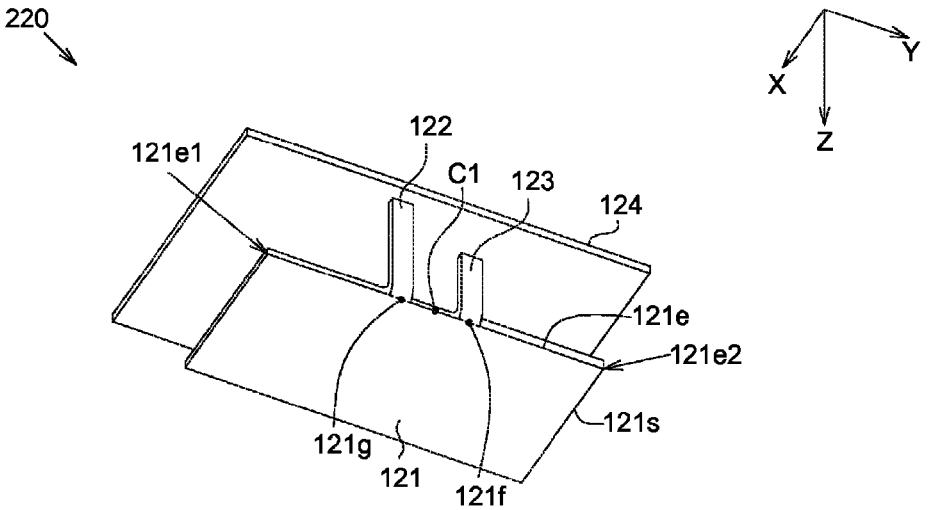
FIG. 2 illustrates a diagram of a patch antenna according to another embodiment of the disclosure.

In another embodiment, the grounding point 121*g* may be located at any position between the center C1 and the first end 121*e*1 of the long edge 121*e*. Similarly, the feeding point 121*f* may be located at any position between the center C1 and the second end 121*e*2 of the long edge 121*e*. For example, referring to FIG. 2, a diagram of a patch antenna according to another embodiment of the disclosure is illustrated. The patch antenna 220 includes the irradiation plate 121, the grounding point 121*g*, the feeding point 121*f*, the grounding pin 122, the feeding pin 123 and the ground plate 124. In the present embodiment, the grounding point 121*g* and the feeding point 121*f* are adjacent to the center C1 of the long edge 121*e*. Furthermore, the distance between the grounding point 121*g* and the center C1 is less than half distance or one-third distance between the center C1 and the first end 121*e*1, and the distance between the feeding point 121*f* and the center C1 is less than half distance or one-third distance between the center C1 and the second end 121*e*2. In another embodiment, the distance between the grounding point 121*g* and the center C1 and the distance between the feeding point 121*f* and the center C1 may be determined by an impedance matching for the patch antenna 220 and/or an operation bandwidth of the patch antenna 220. The above-mentioned operation bandwidth may range between 2.4 GHz and 5 GHz, or other operation bandwidth conforming to WiFi specification.

Figure 3A:
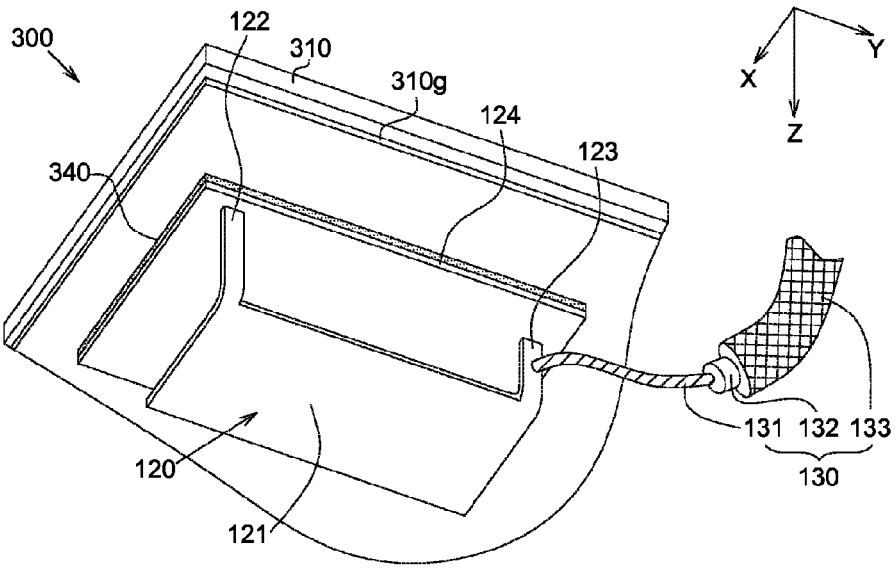
FIG. 3A illustrates a diagram of a wireless communication device according to another embodiment of the disclosure.

Referring to FIG. 3A, a diagram of a wireless communication device according to another embodiment of the disclosure is illustrated. The wireless communication device 300 may include a circuit board 310, the patch antenna 120, the feed line 130 and a conductive adhesive layer 340. In the present embodiment, the circuit board 310 includes a grounding layer 310*g*. The conductive adhesive layer 340 is formed between the grounding layer 310*g* of the circuit board 310 and the ground plate 124 of the patch antenna 120, and accordingly a relative position between the grounding layer 310*g* and the ground plate 124 may be fixed and the grounding layer 310*g* may electrically connect to the ground plate 124.

Figure 3B:
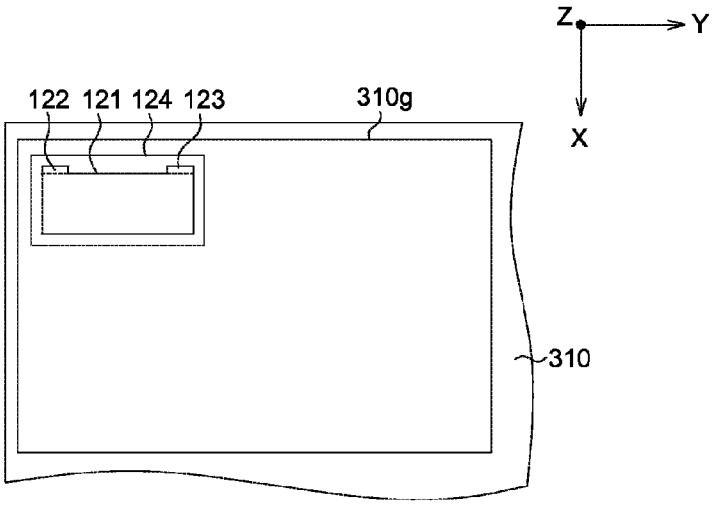
FIG. 3B illustrates a bottom view of the wireless communication device of FIG. 3A.

Referring to FIG. 3B, a bottom view of the patch antenna of FIG. 3A is illustrated. The area of the grounding layer 310*g* is larger than the area of the ground plate 124, and the projection of the entire ground plate 124 along the Z axis overlaps the grounding layer 310*g*. Under such design, the electromagnetic wave irradiated to the grounding layer 310*g* toward −Z axis is reflected by the grounding layer 310*g* to broaden toward two sides with respective to +Z axis, and thus generates the irradiation field P2 as illustrated in FIG. 1B. As illustrated in FIG. 1B, in the irradiation field P2, a radiation angle $\theta_2$ included between two directions of the maximum gains may broaden since the electromagnetic wave is reflected by the grounding layer 310*g*. As compared with the radiation angle $\theta_1$ in the irradiation field P1, the radiation angle $\theta_2$ in the irradiation field P2 is larger than the radiation angle $\theta_1$ in the irradiation field P1. As a result, to cover the same area on a floor, the number of the required wireless communication devices 300 may be further reduced. In another embodiment, the patch antenna 120 of the wireless communication device 300 may be replaced by the patch antenna 220 of FIG. 2, such that the wireless communication device 300 may generate the irradiation field P2 as illustrated in FIG. 1B.

While the disclosure has been described by way of example and in terms of the preferred embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A patch antenna, comprising:
an irradiation plate having a long edge;
a grounding point located at the long edge; and
a feeding point located at the long edge;
wherein the grounding point and the feeding point are symmetrical with respect to a center of the long edge.

2. The patch antenna a according to claim 1, wherein the irradiation plate further has a short edge, and a proportion of the short edge to the long edge ranges between 1:1.87 and 1:3.6.

3. The patch antenna according to claim 1, wherein the irradiation plate further has a short edge, and a proportion of the short edge to the long edge ranges between 1:2.34 and 1:2.35 or 1:2.9 and 1:3.1.

4. The patch antenna according to claim 1, wherein the grounding point and the feeding point are located at two end of the long edge respectively.

5. The patch antenna according to claim 1, wherein the grounding point is located between a first end of the long edge and the center, and the feeding point is located between a second end of the long edge and the center.

6. The patch antenna according to claim 1, further comprises:
a grounding plate parallel to the irradiation plate; and
a grounding pin connecting the grounding point and the grounding plate.

7. The patch antenna according to claim 6, wherein an area of the grounding plate is larger than that of the irradiation plate.

8. A wireless communication device, comprising:
a circuit board comprising a grounding layer; and
a patch antenna according to claim 1;
wherein the patch antenna is disposed on the grounding layer of the circuit board by a grounding plate of the patch antenna.

9. The wireless communication device a according to claim 8, wherein the irradiation plate further has a short edge, and a proportion of the short edge to the long edge ranges between 1:1.87 and 1:3.6.

10. The wireless communication device according to claim 8, wherein the irradiation plate further has a short edge, and a proportion of the short edge to the long edge ranges between 1:2.34 and 1:2.35 or 1:2.9 and 1:3.1.

11. The wireless communication device according to claim 8, wherein the grounding point and the feeding point are located at two end of the long edge respectively.

12. The wireless communication device according to claim 8, wherein the grounding point is located between a first end of the long edge and the center, and the feeding point is located between a second end of the long edge and the center.

13. The wireless communication device according to claim 8, wherein the grounding plate is configured parallel to the irradiation plate, and the wireless communication device further comprises:
a grounding pin connecting the grounding point and the grounding plate.

14. The wireless communication device according to claim 13, wherein an area of the grounding plate is larger than that of the irradiation plate.

15. The patch antenna a according to claim 1, wherein the grounding point contacts the long edge, and the feeding point contacts the long edge.

16. A patch antenna, comprising:
an irradiation plate having a long edge and a short edge;
a grounding point located at the long edge;
a feeding point located at the long edge, wherein the feeding point and the grounding point are symmetrical with respect to a center of the long edge, and the feeding point and the grounding point are adjacent to two ends of the long edge respectively;
a grounding plate parallel to the irradiation plate, wherein an area of the grounding plate is larger than that of the irradiation plate;
a grounding pin connecting the grounding point and the grounding plate;
a feeding pin extending from the feeding point toward the grounding plate; and
a feed line connecting to the feeding pin.

17. The patch antenna a according to claim 16, wherein the irradiation plate further has a short edge, and a proportion of the short edge to the long edge ranges between 1:1.87 and 1:3.6.

18. The patch antenna according to claim 16, wherein the irradiation plate further has a short edge, and a proportion of the short edge to the long edge ranges between 1:2.34 and 1:2.35 or 1:2.9 and 1:3.1.

19. A patch antenna, comprising:
an irradiation plate having a long edge and a short edge;
a grounding point located at the long edge;
a feeding point located at the long edge, wherein the feeding point and the grounding point are symmetrical with respect to a center of the long edge, and the feeding point and the grounding point are adjacent to the center of the long edge;
a grounding plate parallel to the irradiation plate, wherein an area of the grounding plate is larger than that of the irradiation plate;
a grounding pin connecting the grounding point and the grounding plate;
a feeding pin extending from the feeding point toward the grounding plate; and
a feed line connecting to the feeding pin.

20. The patch antenna a according to claim 19, wherein the irradiation plate has a short edge, and a proportion of the short edge to the long edge ranges between 1:1.87 and 1:3.6.

21. The patch antenna according to claim 19, wherein the irradiation plate has a short edge, and a proportion of the short edge to the long edge ranges between 1:2.34 and 1:2.35 or 1:2.9 and 1:3.1.

* * * * *